United States Patent [19]

Ferris et al.

[11] Patent Number: 4,741,274

[45] Date of Patent: May 3, 1988

[54] HOPPER DOOR OPERATING MECHANISM

[75] Inventors: Ray L. Ferris, Thornton; Bradford Johnstone, Flossmoor, both of Ill.; Emmanuel L. Komasinski, Michigan City, Ind.; Maurico F. Rosellini, Butler; William D. Stoughton, Slippery Rock, both of Pa.

[73] Assignee: Trinity Industries, Dallas, Tex.

[21] Appl. No.: 844,798

[22] Filed: Mar. 27, 1986

[51] Int. Cl.[4] ..... B61D 7/18; B61D 7/26; B61D 7/28

[52] U.S. Cl. ..... 105/240; 105/290; 105/253

[58] Field of Search ..... 105/247, 248, 249, 253, 105/289, 308 E, 310, 240, 299

[56] References Cited

U.S. PATENT DOCUMENTS

| | | | |
|---|---|---|---|
| 763,186 | 6/1904 | Johnson . | |
| 1,908,096 | 5/1933 | Yost . | |
| 3,137,247 | 6/1964 | Hamilton et al. | 105/251 |
| 3,187,684 | 6/1965 | Ortner | 105/248 |
| 3,316,857 | 5/1967 | Floehr | 105/240 |
| 3,339,500 | 9/1967 | Dorey | 105/253 |
| 3,343,725 | 9/1967 | Cannon | 105/308 E X |
| 3,373,700 | 3/1968 | Ridder | 105/240 |
| 3,396,675 | 8/1968 | Stevens | 105/280 |
| 3,434,433 | 3/1969 | Floehr | 105/249 |
| 3,446,374 | 5/1969 | Miller | 214/63 |
| 3,447,703 | 6/1969 | Kutch | 214/63 |
| 3,450,065 | 6/1969 | Floehr et al. | 105/290 |
| 3,459,317 | 8/1969 | Shaver | 214/63 |
| 3,515,075 | 6/1970 | Damy | 105/310 X |
| 3,540,605 | 11/1970 | Nagy | 214/63 |
| 3,543,691 | 12/1970 | Nagy | 105/241 |
| 3,596,608 | 8/1971 | Aquino et al. | 105/251 |
| 3,596,609 | 8/1971 | Ortner | 105/240 |
| 3,606,042 | 9/1971 | Schuller | 214/63 |
| 3,606,043 | 9/1971 | Miller | 214/63 |
| 3,611,947 | 10/1971 | Nagy | 105/253 |
| 3,650,221 | 3/1972 | Nagy | 105/240 |
| 3,654,873 | 4/1972 | Floehr | 105/310 X |
| 3,675,590 | 7/1972 | Schuller | 105/240 |
| 3,710,729 | 1/1973 | Schuller | 105/240 |
| 3,717,109 | 12/1973 | Miller | 105/284 |
| 3,772,996 | 11/1973 | Schuller | 105/240 |
| 3,773,194 | 11/1973 | Schuller | 214/63 |
| 3,783,797 | 1/1974 | Shaver | 105/251 |
| 3,815,514 | 6/1974 | Heap | 105/240 |
| 3,818,842 | 6/1974 | Heap | 105/240 |
| 4,084,515 | 4/1978 | Kunz et al. | 105/240 |
| 4,194,450 | 3/1980 | Miller | 105/253 |
| 4,224,877 | 9/1980 | Stark et al. | 105/310 X |
| 4,232,989 | 11/1980 | Miller | 414/387 |
| 4,508,037 | 4/1985 | Rousseau | 105/290 |
| 4,542,701 | 9/1985 | Fischer et al. | 105/289 X |
| 4,601,244 | 7/1986 | Fischer | 105/290 X |

*Primary Examiner*—David A. Scherbel
*Assistant Examiner*—Russell D. Stormer
*Attorney, Agent, or Firm*—Myers & Ehrlich, Ltd.

[57] ABSTRACT

A railway hopper car has longitudinally spaced hoppers on both sides of a center sill. The hoppers have door assemblies which may be opened and closed by a door operating mechanism. The door operating mechanism includes a pneumatic cylinder which rotates a lever to move an operating rod longitudinally within the center sill. Door operating levers are rotatably supported on the railway car and pivotally connected to the operating rod to be rotated when it moves. The door operating levers are pivotally connected with struts connected with the door on the hoppers. The mechanism is configured so that all forces are substantially coplanar in a vertical plane passing through the centerline of the center sill to reduce lateral twisting forces in the mechanism. Adjustment of the length of the strut is provided for positioning of the door operating levers during assembly.

25 Claims, 4 Drawing Sheets

FIG. 2
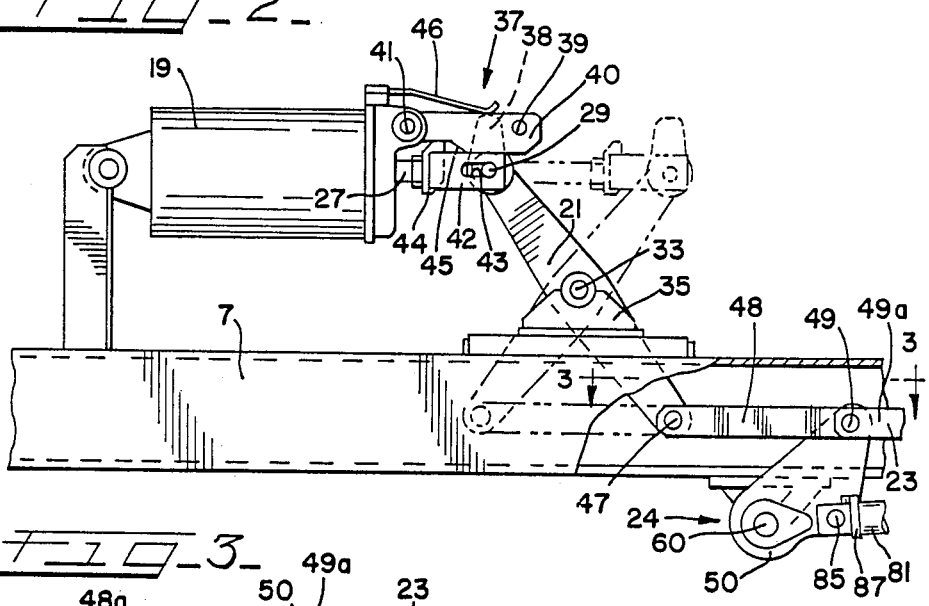
FIG. 3
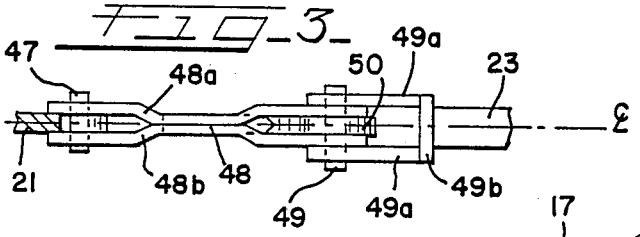
FIG. 4
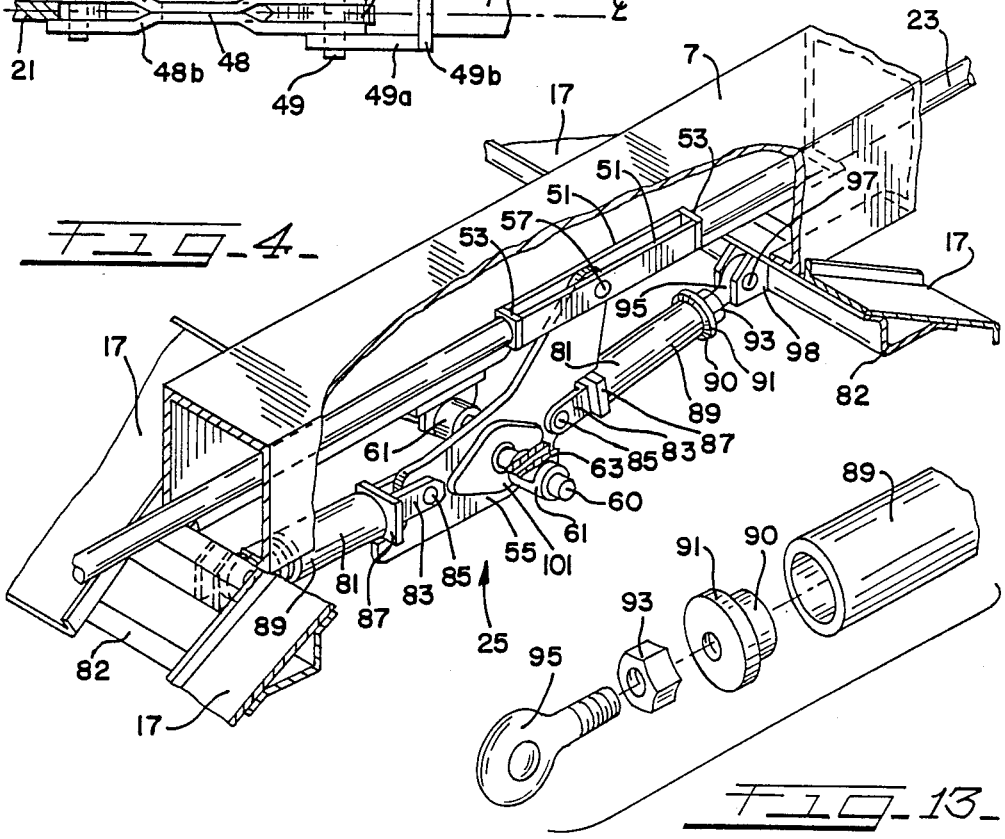
FIG. 13

HOPPER DOOR OPERATING MECHANISM

BACKGROUND OF THE INVENTION

1. Field of the Invention

This invention relates to a mechanism for operating the dump doors on a railway hopper car. More particularly, this invention relates to a mechanism for opening and closing a plurality of dump door pairs covering a plurality of longitudinally spaced hopper outlet openings on the lower end of a railway hopper car.

2. Description of the Prior Art

As shown in U.S. Pat. Nos. 3,596,609 and 4,508,037, one mechanism used in the prior art to open and close a plurality of longitudinally spaced hopper dump door pairs includes a longitudinally extending operating rod which is moved longitudinally by a pressurized air cylinder or other means. This longitudinally extending rod is connected with a plurality of door operating levers connected to actuating shafts extending transversely below the hopper car body. The actuating shafts are rotatable and are connected to linkage mechanisms which may be rotated to open and close the dump doors. Longitudinal movement of the operating rod rotates each door operating lever. Each door operating lever rotates an actuating shaft, which in turn actuates a linkage mechanism to open and close the doors.

One disadvantage of this type of arrangement is that the door operating lever transmits the rotation to the door operating linkage through an actuating shaft. The actuating shaft is flexible and less structurally efficient due to its relatively small diameter on the axis of rotation. The linkage mechanisms are spaced laterally from the levers, resulting in undesirable torques within the mechanism, and also requiring more area on the underside of the hopper car, reducing the size of the dump doors. Also, the shaft extends below the car body and is vulnerable to damage from impacts.

SUMMARY OF THE INVENTION

To provide a more efficient arrangement of hopper door operating structure, the present invention provides for an operating rod extending longitudinally within the center sill. The operating rod is connected to a plurality of door operating levers which are supported for rotation on the center sill between the hopper structures. Each of the door operating levers is connected with struts for opening and closing adjacent of hopper dump doors responsive to movement of the operating rod. The lever is comprised of a single plate body portion with three pivotal connections, one to the operating rod and one to each of a pair of door operating struts, reducing the area required the mechanism. The lever and struts are configured to support the doors in the closed position as an over-center lock.

The pivotal connections to the door operating levers and the struts are coplanar in a substantially vertical plane passing through the transverse centerline of the center sill. This eliminates unnecessary rotational moments within the mechanism.

Because of the plate construction of the lever and the elimination of a separate linkage mechanism, the door operating mechanism of the invention is adapted for use with a Weirton sill, in which the bottom flanges extend inwardly. Use of a Weirton sill allows for maximum area of the underside of the railway car for the hopper dump doors, facilitating unloading of the hopper car.

Other objects and advantages of the invention will be disclosed hereinafter in the specification and the scope of the invention will be articulated in the claims.

BRIEF DESCRIPTION OF THE DRAWINGS

FIG. 2 is an enlarged elevational view as in FIG. 1 showing the pneumatic door operating cylinder and the cylinder lever in the doors-closed position with a portion of the center sill being cut away to show the first door operating lever. The doors-open position of the lever is shown in phantom.

FIG. 3 is a section view taken along line 3—3 of FIG. 2 and showing the connection of the cylinder lever with the operating rod.

FIG. 4 is a perspective view of a longitudinal section of the center sill of the hopper car with a portion of the center sill cut away to show the operating rod and an intermediate door operating assembly of this invention.

FIG. 13 is an exploded perspective view of the adjustment portion of a strut.

DESCRIPTION OF THE PREFERRED EMBODIMENT

Figure 1:
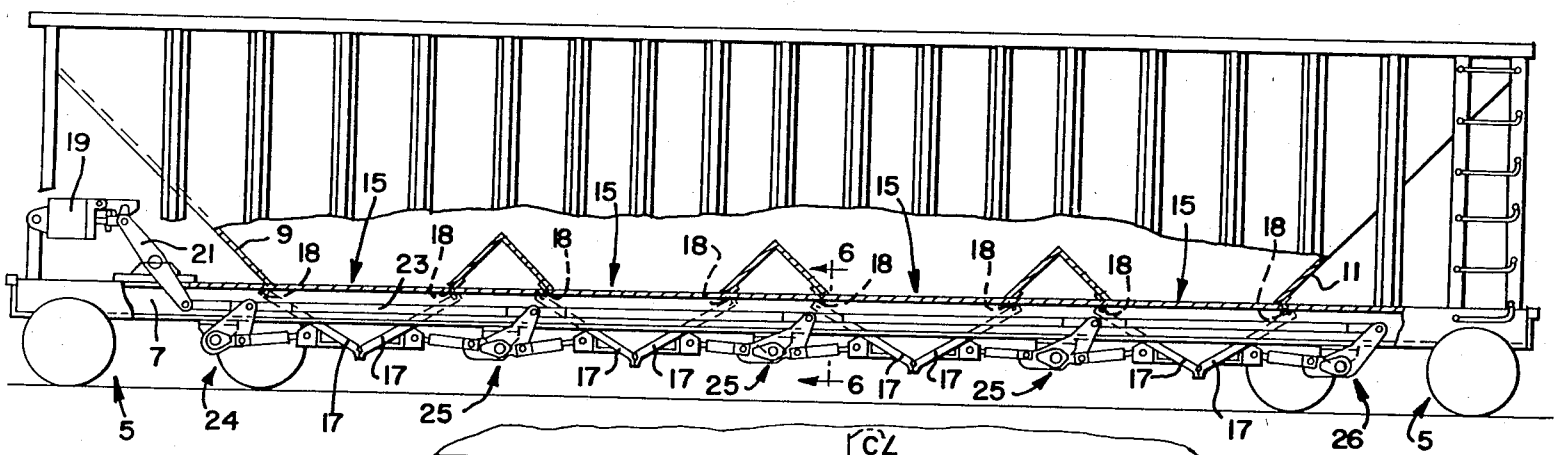
FIG. 1 is an elevational view of a hopper railway car with a portion of the sidewalls cut away to show the hoppers, the dump doors, and the door operating mechanism of this invention.

As shown in FIG. 1, a railway hopper car 3 is supported for longitudinal movement on conventional railway car trucks generally indicated at 5. The hopper car 3 has a longitudinally extending center sill 7 extending substantially the entire length of the car 3. The hopper car is provided with sloping endwalls 9 and 11 and sidewalls 13 which define a cargo carrying space within the hopper car 3. The lower end of the hopper car 3 is provided with a plurality of hopper structures generally indicated at 15 for unloading lading contained in the cargo carrying space. The hopper structures 15 are positioned longitudinally in the hopper car 3 in lateral rows of two, one hopper structure 15 on each side of the center sill 7. Each hopper structure 15 is provided with a pair of dump doors 17 which act in conjunction to cover the discharge opening of the particular hopper structure 15. The dump doors 17 depend from hinges 18 on the hopper structures 15. The hinges 18 extend transversely on the railway hopper car 3, permitting the dump doors 17 to swing downward and longitudinally away from the discharge opening at the lower end of the hopper structure 15 for permitting lading in the cargo carrying space to fall through the hopper structure 15.

The dump doors 17 are controlled by an operator through the use of an operating mechanism activated by a pneumatic cylinder 19 or other force generating means. The cylinder 19 is connected to a cylinder lever 21 which is rotated responsive to pressurization of the cylinder 19. The rotation of the cylinder lever 21 produces longitudinal movement of operating rod or thrust member 23, which extends longitudinally with respect to the hopper car 3 within the center sill 7. The operating rod 23 is operatively connected with a plurality of door operating assemblies generally indicated at 24, 25, and 26 for opening the hopper dump doors 17.

As best shown in FIG. 2, door operating cylinder 19 is provided with a cylinder shaft 27 which is moved longitudinally when the cylinder 19 is pressurized. The cylinder shaft 27 is connected with the upper end of cylinder lever 21 by pivot pin 29. Cylinder lever 21 is pivotally supported on central pivot pin 33 supported on the center sill 7 by cylinder lever pivot mount 35.

A safety lock mechanism generally indicated at 37 requires movement of cylinder shaft 27 before the cylinder lever 21 is free to rotate. This prevents accidental opening of the hopper dump door 17 resulting from forces applied in other parts of the mechanism. The safety lock mechanism 37 comprises a latch portion 38 extending upward from the upper end of the cylinder lever 21. The latch portion 38 is secured against longitudinal movement by locking pin 39 supported on lock member 40. Lock member 40 is pivotally connected by pivot pin 41 to the body of door operating cylinder 19. The cylinder shaft 27 supports a shaft extension member 42 having an elongated slot 43 therein which accomodates upper cylinder lever pivot pin 29. Shaft extension member 42 includes a camming block 44 which is adapted to cammingly engage a camming surface 45 on the underside of lock member 40. Lock member 40 is biased by biasing spring 46 connected to the body of the door operating cylinder 19 to pivot downward so that the lock pin 39 entraps latch portion 38. When the cylinder 19 is pressurized, the cylinder shaft 27 is moved longitudinally and camming block 44 engages camming surface 45 which pivots lock member 40 about pivot pin 41, elevating lock pin 39 to permit longitudinal movement of latch portion 38. Continued extension of the cylinder shaft 27 rotates the cylinder lever 21 about pivot pin 33.

The lower end of cylinder lever 21 is pivotally connected by pin 47 to link portion 48 within the center sill. Link portion 48 is pivotally attached to operating shaft 23 by pivot pin 49 which also serves to connect the first door operating lever 50 of door operating assembly 24 to tie plates 51 supported at one end of operating rod 23. Rotation of the cylinder lever 21 moves the link portion 48 and the connected operating rod 23 longitudinally.

As best shown in FIG. 3, link portion 48 includes a pair of symmetrical link sides **48*a* and 48*b*, the outward ends of which are laterally spaced to receive the lower end of cylinder lever 21 therebetween. The cylinder lever is secured by pivot pin 47 extending through the link sides 48*a* and 48*b*. The link sides 48*a* and 48*b* converge and are rigidly connected as by welding to each other at an intermediate portion. The inward ends of link sides 48*a* and 48*b* diverge to receive first door operating lever 50 which is secured therebetween by pivot pin 49. The end of the operating rod 23 is also secured to the link 48 by pin 48 which extends through tie plates 49*a* connected to end tie plate 49*b***.

Operating rod 23 extends longitudinally within the center sill 7 substantially the length of the railway car 3. The operating rod 23 includes a plurality of spaced connection portions operatively engaging the first door operating assembly 24, the intermediate door operating assemblies 25 and the last door operating assembly 26. The connection portions comprise a pair of laterally spaced vertical center tie plates 51. In connection portions intermediate the ends of the operating rod 23, the tie plates 51 extend between end tie plates 53 which are joined to intermediate tubular sections 54 of operating rod 23.

Figures 8, 9, 10, 11, 12:
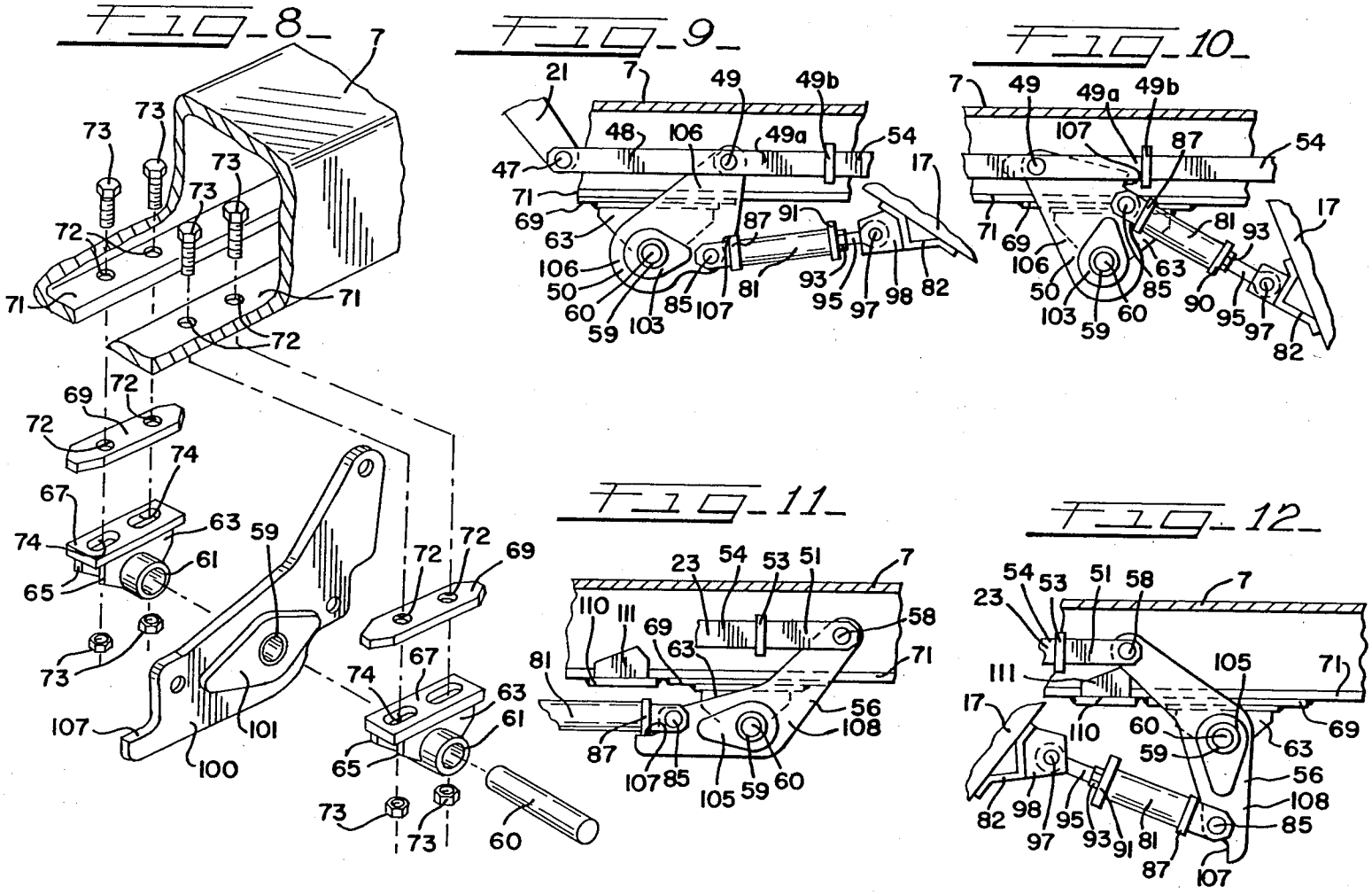
FIG. 8 is an exploded view of an intermediate door operating lever showing the connection of the pivotal support for the door operating lever with the center sill of the hopper car.
FIG. 9 is an elevational view of the first door operating lever, showing the lever in the door-closed position.
FIG. 10 is a view as in FIG. 9, but showing the lever in the door-open position.
FIG. 11 is an elevational view of the last door operating lever, showing the lever in the door-closed position.
FIG. 12 is a view as in FIG. 10, but showing the lever in the door-open position.

As best shown in FIGS. 3, 9 and 10, the connection portion associated with the first operating lever 50 differs from an intermediate connection portion. The first tubular section 54 is connected to an enlarged end tie plate **49*b*, and tie plates 49*a* extend longitudinally therefrom. Tie plates 49*a* are pivotally connected to the first lever 50 and the link portion 48 by pivot pin 49** and terminate slightly outward longitudinally therefrom.

Similarly, at the opposite end of operating rod 23, which is pivotally connected to last door operating lever 56 (see FIGS. 11 and 12), the tie plates 51 extend longitudinally from end tie plates 53 on last tubular section 54. The tie plates 51 are pivotally connected to last door lever 56 by pivot pin 58, and tie plates 51 terminate longitudinally outward therefrom.

As best shown in FIG. 4, each intermediate door operating lever 55 is connected with the operating rod 23 by a pivot pin 57 extending through one end of the door operating lever 55 and also through the center tie plates 51. The door operating lever 55 includes a hub means or bushing 59 mounted thereon. The hub means 59 are rotatably supported on door lever pivot pin 60, which extends through hub means 59 and support hubs 61. The support hubs 61 are fixedly supported by support brackets 63 connected to the center sill 7.

Figure 7:
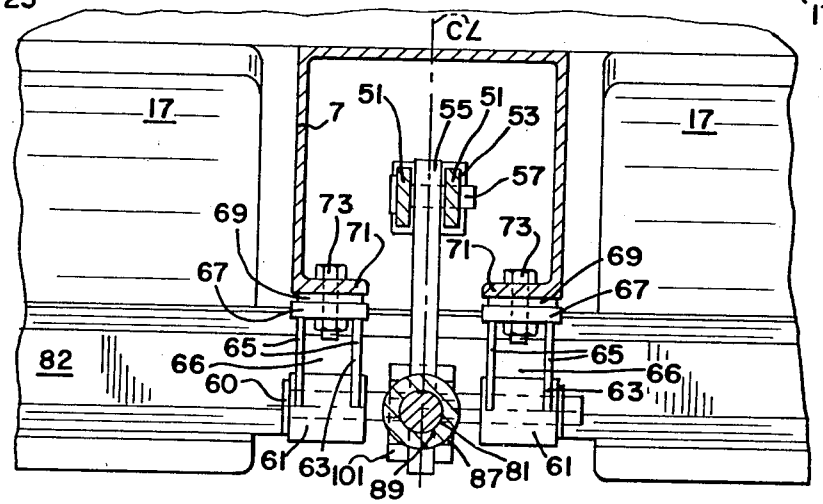
FIG. 7 is a section view of the center sill of the hopper car taken along line 6—6 of FIG. 1.

As best shown in FIGS. 7 and 8, each of the support brackets 63 comprises a pair of laterally-spaced vertically-extending support bracket webs 65. These support bracket webs are rigidly attached to support hub 61 and are reinforced by a reinforcement web 66 extending transversely between the support bracket webs 65. The upper ends of support bracket webs 65 and reinforcement web 66 are connected to a base plate 67. The base plate 67 engages lower center sill flange reinforcement plate 69, which is rigidly connected as by welding to lower center sill flanges 71. Base plate 67 is secured to reinforcement plate 69 by fastener means 73 which extends through openings 72 in lower flange 71 and reinforcement plate 69, and openings 74 in base plate 67. Openings 74 in the base plate are elongated to permit adjustment of the longitudinal position of the support brackets 63 during initial assembly of the hopper car door operating mechanism. Once the support brackets 63 are in the desired adjusted position, the support brackets 63 are then welded to secure them to reinforcement plate 69.

Figure 5:
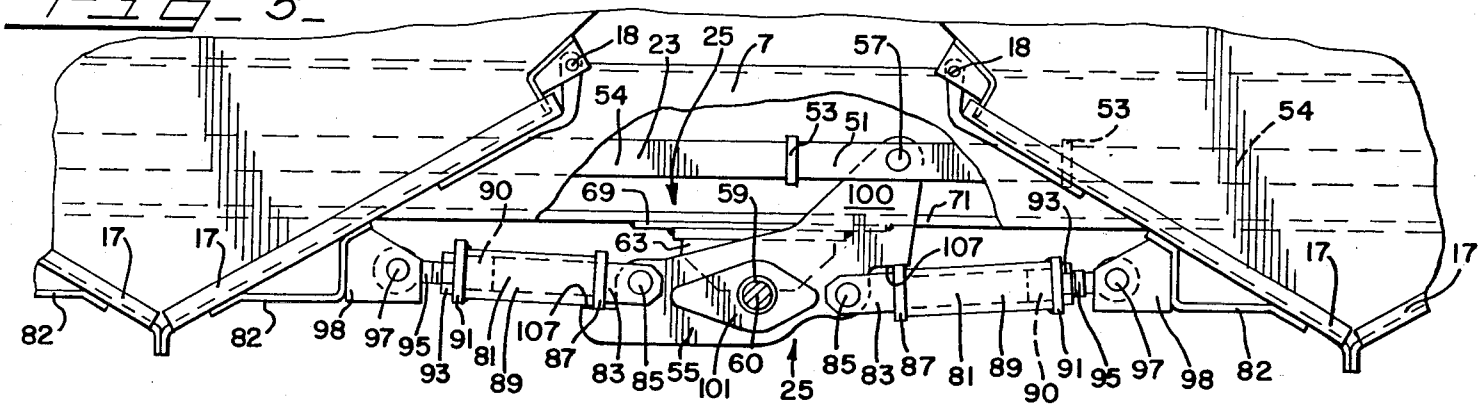
FIG. 5 is an elevational view of a door operating structure of this invention in the door-closed position with a portion of the center sill cut away to show the connection of the door operating lever to the operating rod.
Figure 6:
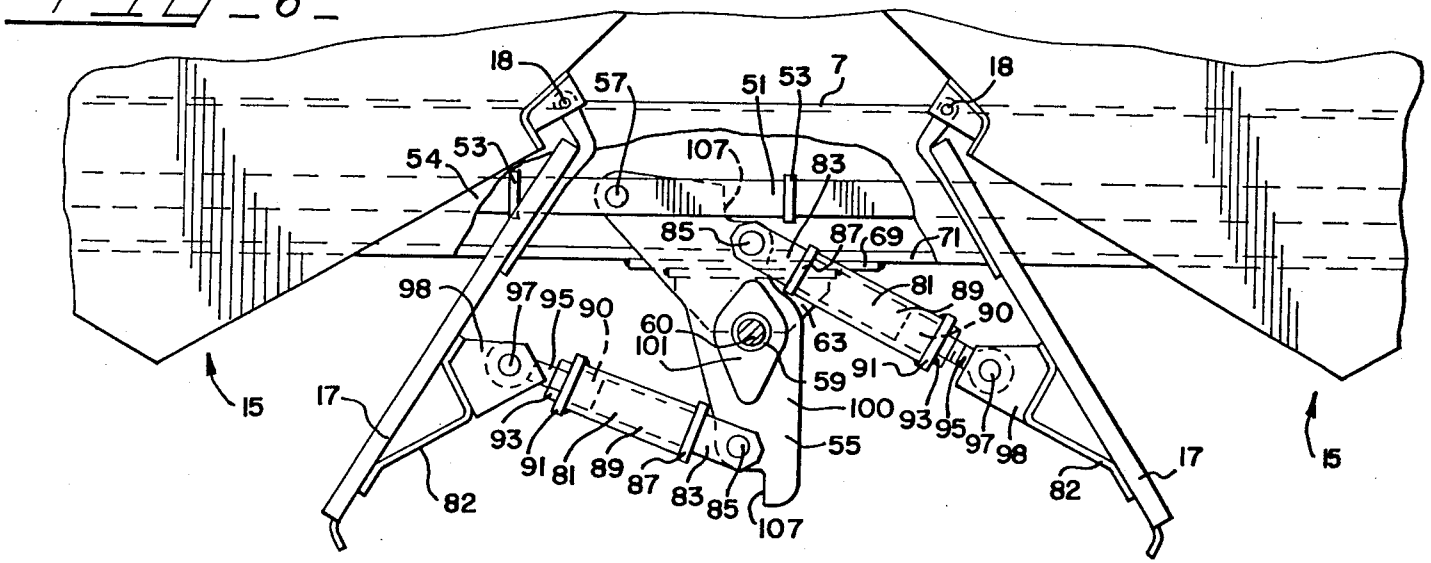
FIG. 6 is a view similar to that shown in FIG. 4, but showing the door operating lever in the door-open position.

As best shown in FIGS. 4, 5, and 6, each intermediate door operating lever 55 is operatively connected with two dump door struts 81. Each of the struts 81 is connected with a connector beam 82 which extends transversely with respect to the railway car 3. The connector beam 82 is mounted on a dump door 17 on a hopper structure 15 on each lateral side of the center sill 7, te doors 17 being those on the side of the hopper structure 15 closer to the particular intermediate door operating lever 55. Each strut 81 is provided with a clevis 83 pivotally connected to a portion of the door operating lever 55 by pivot pin 85. The clevis 83 is connected to a lug 87 mounted at one end of tubular body portion 89 of the strut 81. The other end of the tubular body portion 89 is rigidly connected as by welding to adjustment portion 90 extending into the end of the tubular portion 89. As best shown in FIG. 13, adjustment portion 90 includes shoulder or lug 91 extending outwardly and being welded to the tubular portion 89. Adjustment portion 90 receives the threaded end of eyebolt 95 which is used for fine adjustment of the length of the strut 81 during assembly of the hopper door operating assembly 25. A jam nut 93 is provided on eyebolt 95 to tighten against adjustment member 90 to prevent small clearance movements of the eyebolt 95 within the adjustment portion 90 which would cause wear.

The eyebolt 95 is pivotally connected to door mount clevis 98 by pivot pin 97. Door mount clevis 98 is mounted on the door connector beam 82 affixed to the underside of dump doors 17. Connector beam 82 extends transversely a substantial portion of the width of the hopper railway car 3 and is connected with a dump door 17 on each of two transversely aligned hopper structures 15 on each side of the center sill 7, so that both doors 17 are opened responsive to movement of the associated strut 81.

The intermediate door operating levers 55 each comprise a plate body portion 100 with reinforcing members 101 on each of the lateral sides thereof to rigidify the body portion 100. Reinforcing members 101 surround the hub 59 and extend toward pivot pins 85, the connections to the struts 81.

In the case of the first door operating lever 50, (see FIGS. 9 and 10), the lever 50 is connected with only one strut 81, and is provided with reinforcing member 103 on each side of body portion 106 extending from the hub 59 toward and the single strut pivot pin 85. The last door operating lever 56, shown in FIGS. 11 and 12, is also attached to only a single strut 81. Body portion 108 is provided with reinforcing members 105 extending toward the single strut pivot pin 85, on both sides of the lever 56.

The door operating levers 50, 55, and 56 are also provided with abutment surfaces 107 which engage lugs 87 when the lever 50, 55, and 56 are rotated to the door-closed position, as shown in FIGS. 5, 9 and 11 The abutment provides for the struts 81 being in an over-center locking position with respect to the lever pivot pin 60, securing the dump doors 17 in the closed position without imposing any loads on the operating rod 23.

Adjacent the last door operating lever 56, support plate 110 is fixedly connected as by welding to the bottom flanges 71 of the center sill 7 and extends therebetween. Lever stop 111 is supported to supportingly engage the last door operating lever 56 when it is in the door-open position.

The pivotal connections in the door operating mechanism are provided with hardened bushing inserts (not shown). Hardened bushing inserts are used in the parts engaging pivot pins 29, 33, 47, 49, 57, 58, 60, 85, and 97. These bushing inserts minimize wear in the mechanism and provide for easy replacement of worn pivot contacting surfaces.

DESCRIPTION OF OPERATION

As best shown in FIG. 2, the door operating cylinder 19 is supported on the body of the hopper car 3. When the operator wishes to open the hopper doors 17, pressurized air is applied to the cylinder 19 to push the cylinder shaft 27 outwardly of the cylinder 19, carrying shaft extension member 42 and camming block 44. Camming block 44 engages camming surface 45 and cammingly pivots lock member 40 about pivot pin 41, elevating lock pin 39. This permits latch portion 38 to move in concert with the cylinder shaft 27 to rotate cylinder lever 21 about center pivot pin 33.

Loads applied on the cylinder lever 21 which do not originate in the cylinder shaft 27 do not elevate the lock member 40. As a result, the lock pin 39 continues to block movement of the latch portion 38 and consequent rotation of the cylinder lever 21. This prevents forces transmitted along the operating rod 23 when the doors 17 are closed from moving the cylinder lever 21 and opening the doors 17.

As cylinder lever 21 rotates about center pivot pin 33, the lower end of cylinder lever 21 moves in a downwardly convex arcuate path, drawing link portion 48 with it. The link portion 48 is pivotally connected with the tie plates 51 at the end of operating rod 23 and the first door operating lever 50. Pivot pin 60 rotatably supporting door lever 50 is fixedly supported with respect to the center sill 7, causing pivot pin 49 to travel in an upwardly convex arcuate path when door lever 50 is rotated. Link portion 48 is free to pivot with respect to both the cylinder lever 21 and the first door operating lever 50 to allow for the relative movement thereof.

The operating rod 23 is pivotally connected to the first operating lever 50 by pin 49, to the intermediate door operating levers 55 by pin 57, and to the last door operating lever 56 by pin 58. The connection of the operating rod 23 operates the door operating assemblies 24, 25, 26 simultaneously responsive to movement of the operating rod 23. The operating rod remains generally horizontal during the longitudinal movement thereof. The pivotal connection of the door operating levers 50, 55 and 56 with the center sill 7 causes the pivot pins 49, 57, and 58 travel in an upwardly convex arcuate path with respect to the center sill 7 during operation of the door operating mechanism. As a result, the operating rod over its entire length travels in the upwardly convex arcuate path defined by the pivotal support of the door operating levers 50, 55 and 56.

In the door closed position shown in FIG. 5, the door operating lever 55 is in a position where the longitudinal forces in the struts 81 are supported by an over-center lock configuration. Longitudinal forces in the struts 81 are directed eccentrically with respect to the pivot pin 60, causing a rotational moment in the lever 55 which urges the lever 55 to rotate in what is the clockwise direction in the view shown in FIG. 5. However, abutment surfaces 107 engage lugs 87 on the struts 81 and prevent this rotation. This interaction of the parts in the assembly closes the doors 17 securely so that external forces, such as that caused by lading in the hopper car 3 resting on the dump doors 17 are unable to rotate the lever 55 to force the dump doors 17 open until the operating rod 23 is actuated by the operator.

The first and last door operating levers 50 and 56 are also configured to secure the associated doors 17 in an over-center lock configuration. As shown in FIG. 9, in the door-closed position, the strut 81 connected with first door operating lever 50 loads the pivot pin 60 eccentrically, and the lug 87 engages the abutment surface 107 to form an over-center lock. As shown in FIG. 11, the strut 81 connected with the last door operating lever 56 loads the pivot pin 60 eccentrically in the door-closed position configuration by abutment of lug 87 against surface 107.

When the pneumatic cylinder 19 is actuated by an operator and cylinder lever 21 is rotated, operating shaft 23 is drawn longitudinally in the direction to the left in the views shown in FIGS. 5, 9, and 11. This movement of the operating rod 23 causes each of the door operating levers 50, 55, and 56 to rotate in the counterclockwise direction in the views shown in FIGS. 5, 9, and 11, moving the strut pivot pins 85 out of the over-center lock position. Continued rotation draws the pivot pins 85 connected with the struts 81 toward the vertical center line of the associated door lever pivot pin 60. The movement of the pivot pins 85 draws the struts 81 together in the door operating assembly 25 and progressively causes the dump doors 17 to hingedly move open and uncover the openings in the hopper structures 15. The operation of the first and last door operating assemblies 24 and 26 occurs contemporaneously with that of the intermediate assemblies 25 and is similar to that of the intermediate door operating assemblies 25 except that only a single strut 81 connected to a single dump door 17 is involved. Rotation of the door levers 50 and 56 results in the movement of pivot pin 85 towards the vertical center line of the pin 60 supporting the levers 50 and 56, causing the associated dump door 17 to swing toward the open position, shown in FIGS. 10 and 12.

Movement of the operating rod 23 continues until the last door operating lever 56 engages lever stop 111. In this position door levers 50, 55, and 56 are in the door-open position, as shown in FIGS. 6, 10, and 12. In this position, the operating rod is in tension, being drawn by the cylinder lever 21 and being restrained by last door operating lever 56 abutting the lever stop 111. The hopper dump doors 17 in the open position taper together to act as an extension of the upper hopper and receive loads which tend to open the doors 17 further than the door-open position from lading passing through the hopper structures 15.

In the door-open position, the dump doors 17 angle inwardly to additionally funnel lading passing through the hopper structures 15. The lading imparts loads to the doors 17 which tend to open the doors 17 even further than the open position causing a potentially damaging over-extension of the door operating assemblies 24, 25, and 26. Also, if the railway car is moved while the hopper structures are open, the dump doors 17 may encounter lading piled up below the car, which will also create loads tending to over-extend the door operating assemblies. This over-extension is prevented by lever stop 111 which secures the operating rod 23 and the levers 50, 55, and 56 against the additional movement.

To move the dump doors 17 from the open position shown in FIGS. 6, 10, and 12 to the closed position shown in FIGS. 5, 9, and 11, the pneumatic cylinder 19 is actuated to draw the cylinder shaft 27 back into the body of the cylinder 19. This rotates the cylinder lever 21 back to its original position. The lower end of the cylinder lever 21 pushes the link portion 48 and the connected operating rod 23 back to the original position thereof. The operating rod 23 rotates the door operating levers 50, 55 and 56, reversing the above-described movements to open the doors 17, to the door-closed position, where the lugs 87 of the struts 81 engage abutment surfaces 107 in the over-center lock configuration.

The door operating mechanism of this invention is designed so that essentially all force loading of the mechanism is applied in a single generally vertical plane passing through the centerline of the center sill 7. The cylinder lever 21 is supported in this centerline plane, and the lower end of the cylinder lever 21 engages pivot pin 47 in the centerline plane. Referring to FIG. 3, the link portion 48 receives forces which are transferred longitudinally through the link sides **48*a* and 48*b*, which are symmetrically spaced from the centerline plane to prevent the creation of rotational moments. The forces from the link portion 48 are transferred to the symmetrically spaced tie plates 49*a* of operating rod 23 and to the lever 50, which is supported to rotate within the centerline plane and to receive loads at pin 49** on the centerline.

The operating rod 23 also is aligned along the centerline plane. Referring to FIG. 7, the levers 55 and 56 receive forces at pivot pins 57 and 58 within the centerline plane, whereby longitudinal forces from the operating rod 23 are transmitted to the levers 55 and 56 without creating undesirable rotational moments. The door operating levers 50, 55, and 56 are supported to pivot within the vertical centerline plane of the center sill 7, and the pivotal connections of all of the struts 81 also lie in this vertical centerline plane. As a result, the forces within the mechanism are essentially co-planar within this centerline plane. This results in a reduced tendency of the door operating levers 50, 55 and 56 to deflect and a simpler and more efficient mechanism.

Because the door operating levers 50, 55, and 56 are positioned at the centerline of the center sill 7, and no additional linkage to the doors 17 is required, the linkage arrangement requires a relatively laterally narrow opening at the bottom of the center sill 7 through which the levers 50, 55 and 56 extend. This permits the use of a Weirton center sill, that is, a center sill having bottom flanges 71 extending laterally inward (see FIG. 7). In contrast, the prior art generally made use of a hat-shaped configuration center sill in which the bottom flanges extended laterally outwardly. The advantage of using a Weirton center sill is that a Weirton sill is laterally narrower than a hat-shaped center sill, and this allows a large usable area on the underside of the railway hopper car 3 for the hopper structures 15. This allows for larger area hopper openings in the railway car 3, which provides for faster and more efficient unloading of lading in the hopper car 3.

As best shown in FIGS. 8 and 13, adjustment features are provided for use during assembly on the support hub brackets 63 and on the struts 81 to provide a correct fit of the door operating assembly 24, 25 and 26 with the dump doors 17 and the hopper structures 15.

Lower center sill flange reinforcement plate 69 is welded to the lower flange of the center sill 71, and openings 72 extend therethrough. Baseplate 67 of the support bracket 63 is provided with elongated openings 74 therein through which fastener means 73 may be passed to secure the support bracket 63 to the center sill 7 during assembly. The precise desired position of the lever 50, 55 or 56 supported by the support bracket 63 may be set by loosening the fastener means 73 and moving the support brackets 63 longitudinally over the range of movement permitted by elongated openings 74. When the desired position is reached, the securement means 73 are retightened, and baseplate 67 is welded to the reinforcement plate 69.

Also during assembly, the shoulder 91 of adjustment portion 90 is permitted to abut the tubular body portion 89 at the end closer to the associated dump door 17. During assembly, the adjustment portion 90 and the shoulder 91 are screwed onto the end of the eyebolt 95 (FIG. 13), and the door operating lever 50, 55 or 56 is placed in the door-closed position. The weight of the doors 17 applies a compressive force to the strut 81 which temporarily secures the adjustment portion 90 in the end of the tubular body portion 89. The adjustment portion 90 may then be rotated with respect to the eyebolt 95 and the tubular body portion 89 to adjust the length of the strut 81 and provide for correct closing fit of the doors 17. When the desired fit is achieved, jam nut 96 is tightened against adjustment portion 90 to firmly engage the threading thereof with that of the eyebolt 95 to prevent relative vibration and wear, and the shoulder 91 is welded to the tubular body portion 89 of strut 81. After this welding, adjustments of the length of the strut 81 are accomplished by removing pivot pin 97 to separate the eyebolt 95 from the clevis 98, and then rotating the eyebolt 95 and with respect to adjustment portion 90 to the length desired.

The foregoing description and drawings merely explain and illustrate the invention and the invention is not limited thereto, except insofar as the appended claims are so limited, as those skilled in the art who have this disclosure before them will be able to make modifications and variations therein without departing from the scope of the invention.

Wherefore I claim:

1. In a railway hopper car having a first hopper structure, said hopper structure including a first door assembly supported thereon for opening and closing the hopper structure to unload lading from the interior of the hopper car, a door operating mechanism for opening and closing the door assembly, said door operating mechanism comprising:

a door operator supported on said hopper car and including a movable thrust member, lever means having connection means connected with the thrust member;

means for rotatably supporting said lever means on said hopper car;

said lever means being adapted to rotate responsive to longitudinal movement of the thrust member;

first strut means having a first pivot connection connected with the lever means and a second pivot connection operatively associated with the door for opening and closing the door responsive to rotation of the lever means whereby the door is opened and closed responsive to operation of the door operator; and the first and second pivot connections of the first strut means, the thrust member, and the connection means of the lever means being substantially coplanar within a generally vertical plane extending generally longitudinally with respect to the hopper car for reducing moments in the mechanism about vertical and longitudinal axes.

2. The invention according to claim 1, and the hopper car having a center sill and the thrust member extending within said center sill.

3. The invention according to claim 2, and the center sill having lower flanges extending laterally inwardly with respect thereto.

4. The invention according to claim 1, and the hopper car having a second hopper structure thereon longitudinally spaced from the first hopper structure, the lever means being supported therebetween, the second hopper structure having a second door assembly for opening and closing the second hopper structure, second strut means having a first pivotal connection connected with the lever means and a second pivotal connection connected with the second door assembly the opening and closing thereof in concert with the door assembly of the first hopper structure.

5. The invention according to claim 4, and the first and second pivot connections of the first strut means, and the first and second pivotal connections of the second strut means, and the connection means of the lever means being substantially coplanar in a generally vertical plane thereby reducing torsional loading in the thrust member, the lever means and the first and second strut means.

6. The invention according to claim 5, and the generally vertical plane extending through the transverse center-line of the thrust member.

7. The invention according to claim 1, and said hopper structure having a second door assembly thereon adapted to co-act with the first door assembly to close the hopper structure, the door operating mechanism including:

a lever movably connected with the thrust member;

means for rotatably supporting the lever on the railway car; and a strut pivotally connected with the lever and operatively associated with the additional door for opening and closing the door and whereby longitudinal movement of the thrust member causes the lever and the lever means to open and close the first and second door assemblies in concert.

8. The invention according to claim 1, and said door operator having a pressurized fluid cylinder on the railway car having a cylinder shaft thereon adapted to move responsive to pressurization of the cylinder, and cylinder lever means pivotally supported on the hopper car, said cylinder lever means having a first end portion connected with the cylinder shaft and a second end portion connected with the thrust member whereby pressurization of the cylinder rotates the cylinder lever means and moves the thrust member longitudinally to open the door assembly.

9. The invention according to claim 8, and link means for connecting one end of the thrust member with the second end portion of the cylinder lever means, said link means being pivotally connected with the thrust member and the cylinder lever means.

10. The invention according to claim 1, and said lever means having abutment means thereon; and said strut means being adapted to eccentrically load the lever means when the door assembly is closed, said strut means having a portion engaging said abutment means for securing the door assembly in an over-center lock configuration.

11. The invention according to claim 1, and pivot means supported on said hopper car; and the lever means having hub means engaging the pivot means for pivotally supporting the lever means on the pivot means.

12. The invention according to claim 11, and the railway car having a longitudinally extending center sill thereon, bracket means connected with the center sill and supporting the pivot means;

said bracket means having a base member, said base member and said center sill having aligned openings therein; fastening means extending through said openings for securing the bracket means on the center sill;

said openings in the bracket means being longitudinally elongated to allow for longitudinal adjusting movement of the bracket means with respect to the center sill when the fastening means is loosened.

13. The invention according to claim 1, and the lever means comprising a plate portion.

14. The invention according to claim 13, and the lever means having reinforcing means thereon for rigidifying the plate portion.

15. The invention according to claim 1, and the thrust member extending generally within said vertical plane.

16. The invention according to claim 15, and the railway hopper car having a center sill extending longitudinally with respect to the hopper car, the centerline of said center sill being generally within said vertical plane.

17. The invention according to claim 1, and said railway hopper car having a center sill extending longitudinally with respect thereto, said first hopper structure being supported to one lateral side of the center sill, and a second hopper structure supported on the hopper car on the side of the center sill opposite the first hopper structure, said second hopper structure having a second door assembly thereon for opening and closing the second hopper structure, and connector means connecting said first and second doors with said first strut means whereby the first and second doors are opened and closed responsive to movement of the first strut means.

18. The invention according to claim 17, and said means for adjusting including a threaded adjustment member receiving a threaded bolt means for incrementally adjusting the length of the strut by relative rotation of the adjustment member relative to the threaded bolt means.

19. The invention according to claim 1, and said strut means having means for adjusting the length thereof to provide for full closing of the door assembly.

20. The invention according to claim 1, and lever stop means supported on the hopper car and engaging the lever means when the door is opened for limiting the movement of the door and lever means to prevent damage to the door operating mechanism.

21. The invention according to claim 1, and said lever means comprising an integral body portion engaging the first pivot connection and being rotatably supported on the hopper car;

the connection means comprising pivot means connected with the thrust member and engaging the body portion whereby movement of the thrust member is transmitted to the body portion to cause the door to open.

22. A railway hopper car comprising:

a car body;

a hopper structure being supported on the car body and having a door assembly for opening and closing the hopper structure to unload lading from the interior of the railway hopper car; and a door operating mechanism for opening and closing the door assembly, the door operating mechanism comprising:

a door operator being supported on the hopper car and including a movable thrust member having a connection portion;

the connection portion including a pair of transversely spaced first tie members;

lever means being rotatably supported on the car body and extending between the first tie members;

pivot means engaging the lever means and the first tie members whereby longitudinal movement of the thrust member causes rotation of the lever means and the lever means is rotated without lateral forces or twisting moments; and strut means pivotally engaging the lever means, and said strut means being operatively associated with the door assembly whereby the hopper structure is opened and closed responsive to movement of the thrust member.

23. The invention according to claim 22, and said door operator including a pneumatic cylinder having a cylinder shaft supported therein for oscillation;

a cylinder lever member being pivotally supported on the car body and connected with the cylinder shaft to rotate responsive to oscillation thereof;

a link means having two side portions, the side portions each having one first laterally spaced end portions pivotally receiving the cylinder lever member therebetween and second laterally spaced end portions receiving the thrust member therebetween whereby the force of the pneumatic cylinder is transferred from the cylinder lever member to the thrust member without lateral twisting moments.

24. A railway hopper car comprising:

a car body;

first and second longitudinally spaced hopper structures supported on the car body;

each of said hopper structures having a door assembly thereon for opening and closing the respective hopper structure;

a door operator being supported on the car body and having a longitudinally extending thrust member movable with respect to the car body;

lever means rotatably supported on said car body and having connection means connected to the thrust member;

first strut means having first pivot means connected with the lever means and operatively associated with the door assembly of the first hopper structure for opening and closing the first hopper structure responsive to rotation of the lever means; and second strut means having second pivot means connected with the lever means and operatively associated with the door assembly of the second hopper structure for opening and closing the second hopper structure responsive to rotation of the lever means; and said first and second pivot means, lever means, and thrust member being generally coplanar within a generally vertical plane extending longitudinally with respect to the car body for reducing rotational moments in the mechanism.

25. The invention according to claim 24, and lever stop means supported on the hopper car and engaging the lever means when the door is opened for limiting the movement of the door and lever means to prevent damage to the door operating mechanism.

* * * * *